US010743374B2

(12) United States Patent
Capraro et al.

(10) Patent No.: US 10,743,374 B2
(45) Date of Patent: Aug. 11, 2020

(54) ARMORED RESISTOR AND MANUFACTURING PROCESS THEREOF

(71) Applicant: I.R.C.A. S.P.A. INDUSTRIA RESISTENZE CORAZZATE E AFFINI, San Vendemiano (IT)

(72) Inventors: Duilio Capraro, Conegliano (IT); Federico Zoppas, Treviso (IT); Paolo De Noni, Conegliano (IT)

(73) Assignee: I.R.C.A. S.P.A. INDUSTRIA RESISTENZE CORAZZATE E AFFINI, San Vedemiano (IT)

( * ) Notice: Subject to any disclaimer, the term of this patent is extended or adjusted under 35 U.S.C. 154(b) by 233 days.

(21) Appl. No.: 15/748,451

(22) PCT Filed: Jul. 29, 2016

(86) PCT No.: PCT/IB2016/054574
§ 371 (c)(1),
(2) Date: Jan. 29, 2018

(87) PCT Pub. No.: WO2017/017655
PCT Pub. Date: Feb. 2, 2017

(65) Prior Publication Data

US 2018/0235034 A1 Aug. 16, 2018

(30) Foreign Application Priority Data

Jul. 30, 2015 (IT) ..... 102015000040138

(51) Int. Cl.
*H05B 3/52* (2006.01)
*H05B 3/04* (2006.01)
(Continued)

(52) U.S. Cl.
CPC ..... *H05B 3/52* (2013.01); *H05B 3/04* (2013.01); *H05B 3/06* (2013.01); *H05B 3/44* (2013.01); *H05B 3/48* (2013.01); *H01C 17/00* (2013.01)

(58) Field of Classification Search
CPC ... H05B 3/04; H05B 3/44; H05B 3/52; H01C 17/04
See application file for complete search history.

(56) References Cited

U.S. PATENT DOCUMENTS 2,846,537 A 8/1958 Thornhill
3,694,626 A * 9/1972 Harnden, Jr. ..... H05B 3/48 219/541
(Continued)

FOREIGN PATENT DOCUMENTS

CN 1039519 A 2/1990
CN 102123530 A 7/2011
(Continued)

OTHER PUBLICATIONS

Written Opinion of the International Preliminary Examining Authority for PCT/IB2016/054574, dated Aug. 4, 2017.

*Primary Examiner* — Kyung S Lee
(74) *Attorney, Agent, or Firm* — Abelman, Frayne & Schwab

(57) ABSTRACT

An armored resistor (1) comprising a tubular casing (2) in which a metallic heating element (3) immersed in an electrically insulating material (4) is arranged. Furthermore, a first closing element (5) and a second closing element (6) of the tubular casing (2) are provided, in which the first closing element (5) is fluid-tightly fixed to the respective first end (7) of the tubular casing (2), and the second closing element (6) is provided with at least one at least one radial protrusion (15) which abuts on the second end (8) of the tubular casing (2), and which delimits at least one passage (16) commu-
(Continued)

nicating with the inside of the tubular casing (2), adapted to allow the passage of the electrically insulating material during the manufacturing of the armored resistor.

7 Claims, 7 Drawing Sheets

(51) Int. Cl.

| | |
|---|---|
| ***H05B 3/44*** | (2006.01) |
| ***H01C 17/00*** | (2006.01) |
| ***H05B 3/06*** | (2006.01) |
| ***H05B 3/48*** | (2006.01) |

(56) References Cited

U.S. PATENT DOCUMENTS

| | | | | |
|---|---|---|---|---|
| 3,881,163 | A * | 4/1975 | Lindroth | H05B 3/06 338/302 |
| 4,263,577 | A * | 4/1981 | Bauchert | H05B 3/48 219/544 |
| 5,066,852 | A * | 11/1991 | Willbanks | H05B 3/48 219/541 |
| 5,221,916 | A * | 6/1993 | McQueen | G01F 1/002 219/544 |
| 5,406,053 | A * | 4/1995 | Masreliez | B23K 3/0315 219/229 |
| 6,191,400 | B1 * | 2/2001 | Cunningham | H05B 3/48 219/543 |
| 6,486,442 | B2 * | 11/2002 | Wheeler | H05B 3/44 219/243 |
| 6,812,432 | B1 * | 11/2004 | Haluschka | F23Q 7/001 123/145 A |
| 7,496,284 | B2 * | 2/2009 | Pleschinger | H05B 3/44 392/480 |
| 2007/0170166 | A1 | 7/2007 | Lin | |
| 2007/0194007 | A1 | 8/2007 | Pleschinger et al. | |

FOREIGN PATENT DOCUMENTS

| | | | |
|---|---|---|---|
| CN | 104202854 | A | 12/2014 |
| EP | 0756439 | A1 | 1/1997 |

* cited by examiner

ARMORED RESISTOR AND MANUFACTURING PROCESS THEREOF

CROSS-REFERENCE TO RELATED APPLICATION

This application claims benefit under 35 U.S.C. § 371 to international application No. PCT/IB2016/054574, filed on Jul. 29, 2016, which claims priority to Italian application no. 102015000040138, filed Jul. 30, 2015, the contents of which are incorporated by reference in their entireties.

FIELD OF THE INVENTION

The present invention relates to an armored resistor in which is provided a resistance wire inserted in a tube-shaped metal casing, which is filled with electrically insulating material, e.g. magnesium oxide, and to a manufacturing process thereof.

BACKGROUND ART

Armored electrical resistors are generally used in household appliances which are in contact with water, such as washing machines, dishwashers, boilers or the like. Typically, these resistors are formed by a resistance wire coaxially inserted in a tubular metal casing, which is filled with electrically insulating powder, e.g. magnesium oxide, which is then consolidated. The resistance wire is connected with pins which protrude from the ends of the casing and which have the function of connecting to the electrical power supply system.

Closing elements which are sealed to the casing are present at each end of the casing.

Disadvantageously, the sealing is generally performed by means of resins, e.g. epoxy or polyurethane. This implies the need to implement particularly complex polymerization processes by means of specific apparatuses, requiring a high degree of accuracy.

Furthermore, the armored resistors are disadvantageously formed by a relatively high number of parts, of which also several parts forming the casing, which are mutually joined, in general by brazing.

The armored resistors may envisage safety devices, typically a thermal fuse, which has the function of interrupting the electrical current in case of unexpected overheating of the heating element. In particular, the thermal fuse is usually arranged outside the tubular casing and electrically connected to the resistance wire by means of brackets, thus making the entire armored resistor bulkier and of more complex construction.

Disadvantageously, an armored resistor of this type has some drawbacks, in particular due to the length of the armored resistor itself. For example, for some applications it is desirable to have an armored resistor which does not exceed a given length. One of the reasons for reducing the size of the armored resistor is that the space available for housing it, is rather small. Another reason is related to excessive resistance, due to the excessive total length of its components, which implies a slower heat transmission from the heating element to the thermal fuse and a lower operating sensitivity of the latter, due to the longer distance between fuse and heating element, with consequent larger dimensions and longer reaction times of the thermal fuse. Less reliability and a shorter working life thus derive.

Although an armored resistor in which the thermal fuse is housed in a closing element has been suggested, such a solution is not free from drawbacks. A disadvantage is that the casing must be pressed in order to provide a better heat exchange between resistance wire and its casing. Such an operation is performed by making the entire armored resistor pass through a roller mill. This implies that the part in which the thermal fuse is housed is also subjected to the rolling pressure with the consequent risk of damaging the thermal fuse, which is a particularly delicate component. Disadvantages also appear when a thermal fuse is not envisaged; indeed, a roller mill cannot be used for compacting armored resistors shorter than a given length.

It is thus felt the need to make an armored resistor which allows to overcome the aforesaid drawbacks.

SUMMARY OF THE INVENTION

It is an object of the present invention to provide a more compact armored resistor, in particular shorter than the prior art.

It is another object of the present invention to provide an armored resistor which consists of a lower number of components and which is easier and more cost-effective to make with respect to the prior art.

It is another object of the present invention to provide an armored resistor provided with at least one thermal fuse arranged near the heating element so as to be particularly reactive and reliable in case of malfunctions.

It is a further object of the invention to provide a process for manufacturing such a type of armored resistor.

The present invention thus achieves at least one of the such objects by making an armored resistor which, according to claim 1, comprises

- a tubular casing defining a longitudinal axis and having a first end and a second end;
- a metal, spiral-coiled heating element, arranged inside the tubular casing, immersed in an electrically insulating material, and having two ends;
- a first closing element and a second closing element fixed to the first end and to the second end, respectively, and each provided with a respective through hole;
- two pins adapted to be connected to a source of electricity, in which each pin is in electrical contact with one of said two respective ends of the heating element and wherein each pin passes through a respective closing element; wherein
- the first closing element is fluid-tightly fixed to the respective first end of the tubular casing, and
- the second closing element is provided with at least one passage communicating with the inside of the tubular casing, adapted to allow the electrically insulating material in the form of powder to pass when manufacturing the armored resistor.

According to an aspect, in accordance with claim 9, the invention provides a process for manufacturing an armored resistor having the features of claim 1, in which there are provided the steps of:

a) inserting each pin into a respective hole of the first closing element and second closing element;

b) fixing each pin to a respective third end and fourth end of the heating element, thus producing an intermediate assembly;

c) inserting the intermediate assembly into the tubular casing, so that the first closing element and the respective pin enter first, and make the second closing element abut on the second end of the tubular casing;

d) fixing the first closing element to the first end of the tubular casing;

e) filling the tubular casing with electrically insulating material in the form of powder by means of the at least one passage;

f) consolidating the electrically insulating material so as to make it a compact mass.

Advantageously, the thermal fuse may be inserted in the closing element, which may be a washer. In this manner, the thermal fuse is near the heating element, i.e. the resistance wire, so as to be promptly and accurately sensitive to malfunctions of the armored resistor or of a device which comprises it, e.g. when excessive heating of the resistance wire occurs.

Advantageously, the closing element provided with at least one opening for filling the casing with insulating material allows a manufacturing process of the armored resistor which is more efficient and more effective than the prior art.

Advantageously, the length of the armored resistor may be less than that of the prior art, e.g. it may be shorter than 250 mm, in particular 120-160 mm.

Advantageously, the casing may be a single metal material extruded, e.g. made of aluminum or stainless steel.

Advantageously, the section of the central portion of the tubular casing may be smaller than the two end portions. Such a geometry of the central portion may be advantageously obtained by pressing from the outside, e.g. by means of jaws. An advantage of being able to press only the central portion of the tubular casing is that the thermal fuse(s) possibly present in the closing element are not subjected to pressing and thus are not damaged by such an operation. Furthermore, the central portion of the tubular casing may have a non-cylindrical shape, while the end portions may be cylindrical. This makes it possible to fix further O-rings about the end portions.

Preferably, the fluid-tight fixing of the closing elements to the casing is performed mechanically, even more preferably in exclusively mechanical manner.

Preferably, the resistance wire is arranged coaxially with respect to the tubular casing.

The dependent claims describe preferred embodiments of the invention.

BRIEF DESCRIPTION OF THE FIGURES

Further features and advantages of the present invention will be apparent in the light of the detailed description of a preferred, but not exclusive, embodiment of an armored electrical resistor and to a manufacturing process thereof, illustrated by way of non-limitative example, with the aid of the accompanying drawings, in which:

FIG. 1 shows a section view of a first embodiment of the invention;

FIGS. 1*a*-3*a* show further embodiments of the first embodiment, respectively;

FIGS. 4*a*-6*a* show further variants of the second embodiment of the invention, respectively;

The same reference numbers in the figures identify the same elements or components.

DETAILED DESCRIPTION OF A PREFERRED EMBODIMENT OF THE INVENTION

Figures 1, 1A:
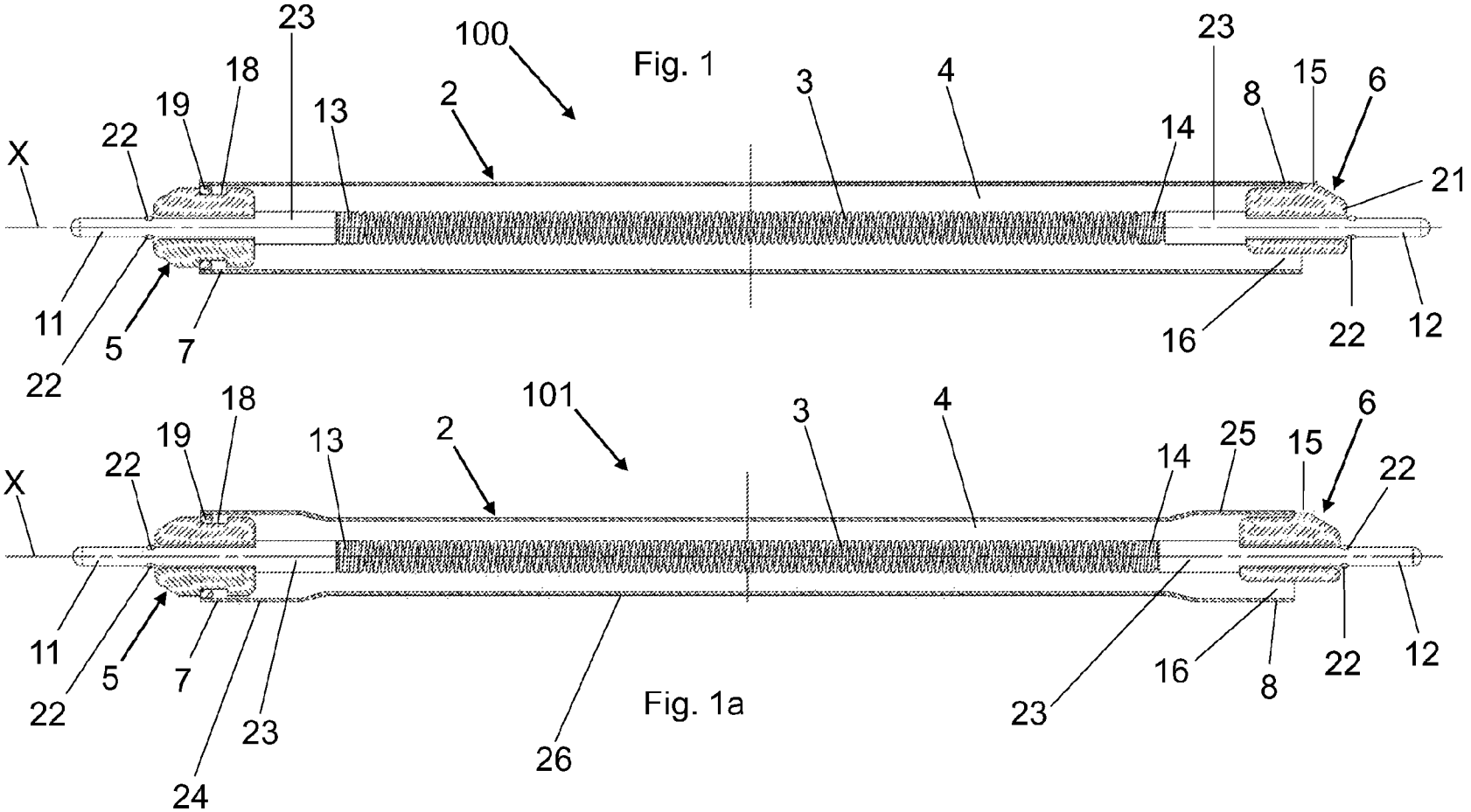

With particular reference to FIG. 1, according to a first embodiment, the armored resistor 100 of the present invention comprises a tubular casing 2 which defines a longitudinal axis X in which a metal heating element 3 is arranged, e.g. metal, spiral-coiled heating element. The tubular casing 2, preferably but not exclusively has a circular section, is internally hollow and the resistance wire 3 is immersed in an electrically insulating material 4, e.g. magnesium oxide. The tubular body 2 is typically made of metallic material, e.g. aluminum or stainless steel, and its length is preferably but not exclusively comprised between 120 and 200 mm, e.g. 160 mm. A first closing element 5 and a second 6 closing element, or washers, are provided at a respective end 7, 8 of the tubular casing 2.

The closing elements 5, 6 are provided with a respective through hole and both are crossed by a respective pin 11, 12. Each pin 11, 12 is coaxial and electrically connected to the resistance wire 3, in particular to the two ends 13, 14, respectively.

The holes may be completely obstructed by the pins and possibly by other filler material or not. Each pin 11, 12 extends along the longitudinal axis X both inside and outside the tubular casing 2, protruding beyond the closing element 5, 6 in which it is housed. The pins 11, 12 are adapted to be connected to a source of electricity, not shown.

The first closing element 5 is partially inserted in the tubular casing 2. The closing element 5 is provided with a peripheral groove 18. An O-ring 19, e.g. made of elastomeric material, is housed in the peripheral groove 18. The geometric center of the O-ring 19 lies on the longitudinal axis X. By virtue of the O-ring 19, which is arranged fluid-tightly between the groove 18 and the inner wall of the tubular casing 2, a fluid-tight closure is provided between the first closing element 5 and the tubular casing 2.

Figure 6:
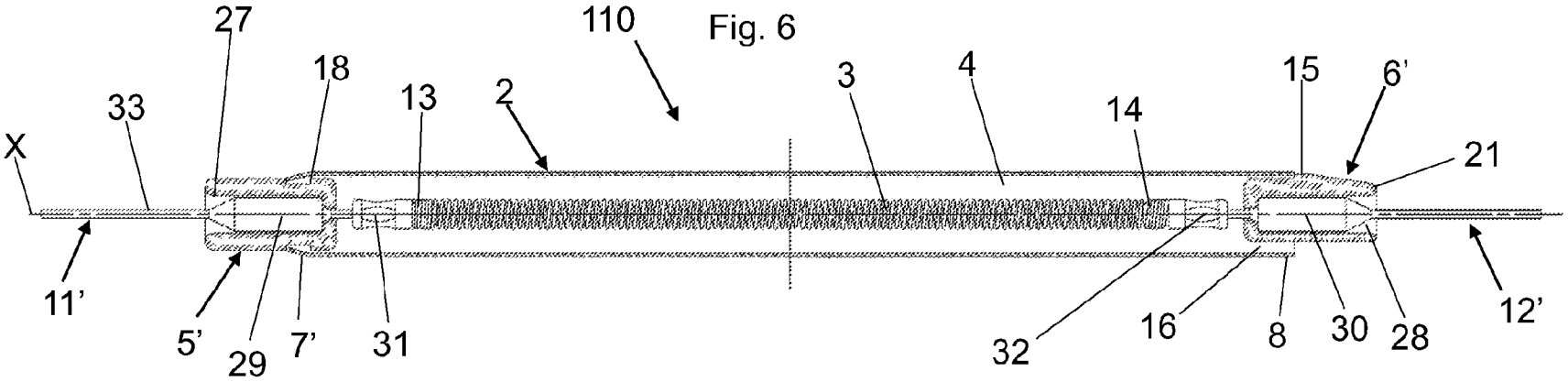
FIG. 6 shows a section view of another variant of the second embodiment of the invention.

The second closing element 6, a top plan view of which is shown in FIG. 6, is partially inserted in the tubular casing 2. The second closing element 6 is provided with at least one radial protrusion 15 which abuts on the end 8 of the tubular casing 2, and which delimits at least one passage 16 communicating with the inside of the tubular casing 2. The at least one passage 16 allows the passage of the electrically insulating material in form of powder during the manufacturing of the armored resistor. Preferably, the second closing element 6 has a central, substantially circular section or circular portion 21, from which three radial protrusion extensions 15, which delimit three passages 16, extend. The diameter of the circular portion 21 is smaller than the diameter of the tubular casing 2.

The through hole 20 of the second closing element 6 is preferably obtained in central position with respect to the circular portion 21, in which the pin 12 extends. The pins 11, 12 are shaped so as to be fixed to the respective closing element 5, 6. Preferably, a portion of the part of each pin 11, 12 which is external to the tubular casing 2, and adjacent to the respective closing element 5, 6, has at least two zones 22, the diameter of which is larger than the through hole 20. Such zones can be obtained, for example, by pressing the pin with pincers or appropriate jaws. Each pin 11, 12 also has a portion 23, inside the tubular casing 2, the diameter of which is larger than the hole 20, so as to abut on the closing element 6 inside the tubular casing 2. The pins 11, 12 are fixed to the respective closing element 5, 6 by virtue of the zones 22 and of the portion 23.

Figure 2:
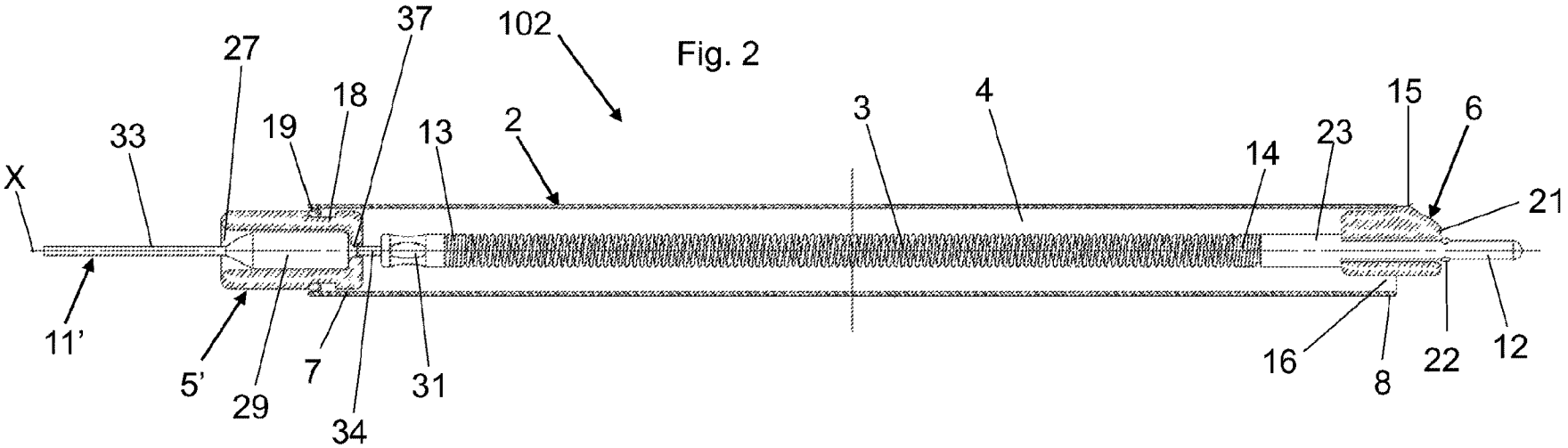
FIG. 2 shows a section view of a variant of the first embodiment of the invention.
Figure 2A:
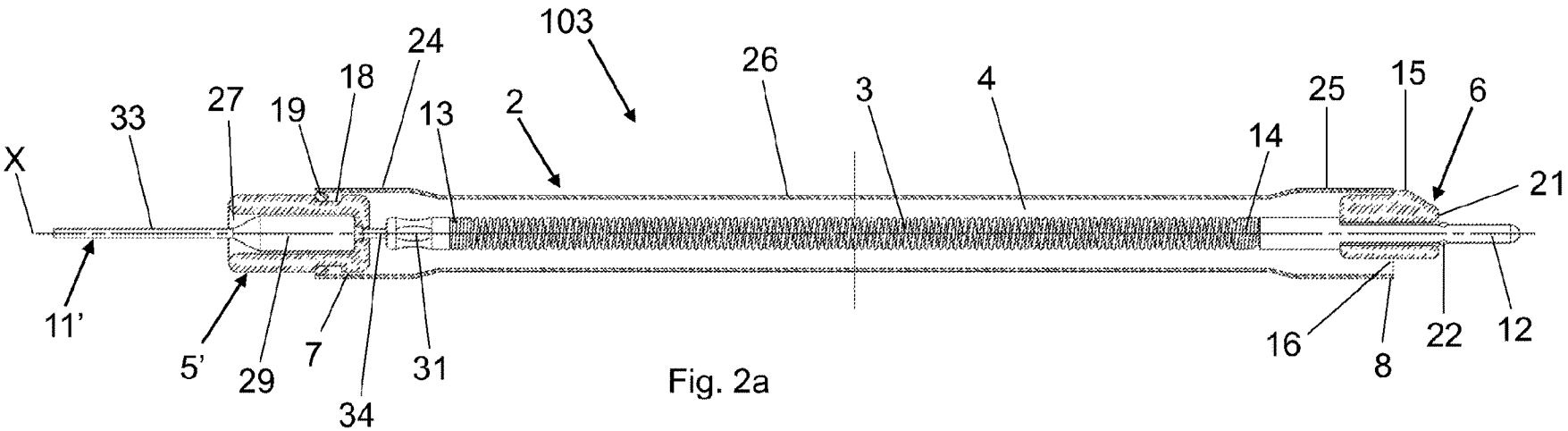
Figure 9:
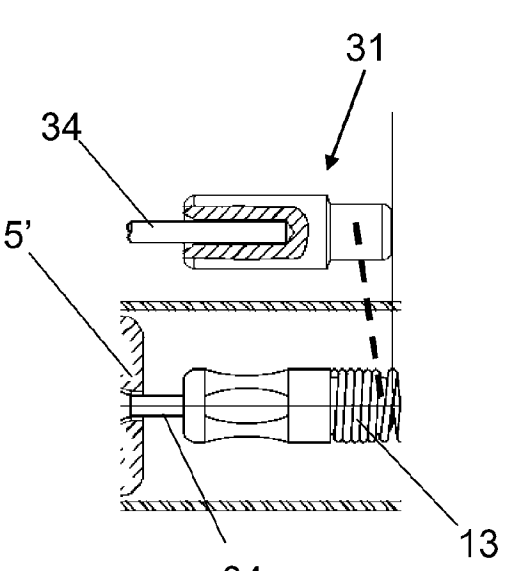
FIG. 9 shows two details of the armored resistor according to the invention.
Figure 8:
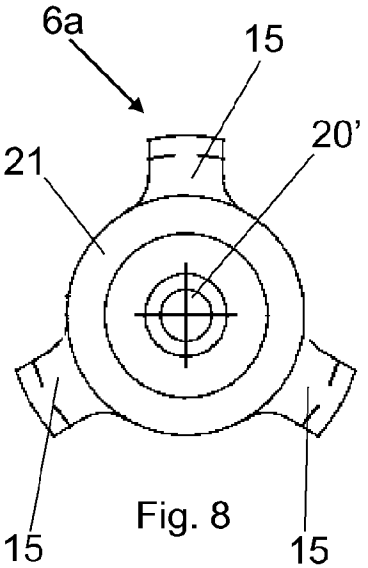
FIG. 8 shows a top view of an alternative component to that in FIG. 7.
Figure 7:
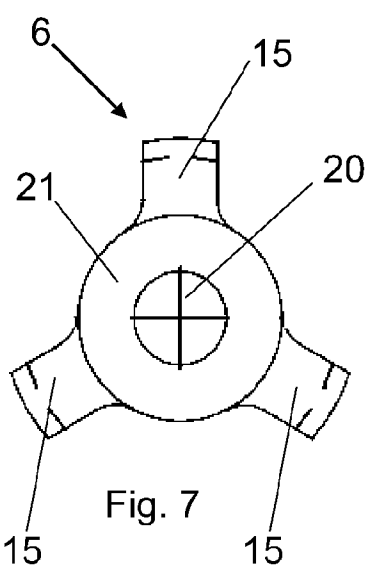
FIG. 7 shows a top view of a component of an armored resistor according to the invention.
Figure 10A:
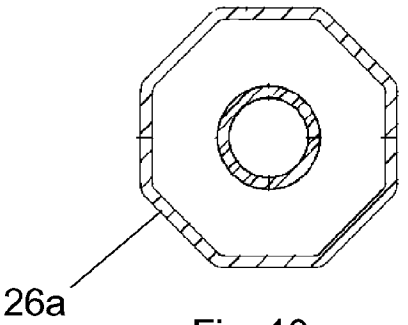
FIGS. 10*a*-10*d* show some possible sections of the central portion of the tubular casing of the armored resistor according to the invention, respectively.
Figure 10B:
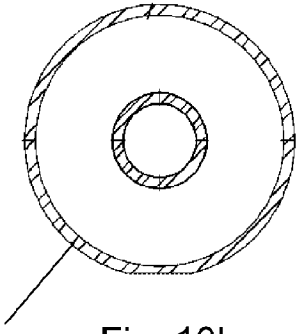
Figure 10C:
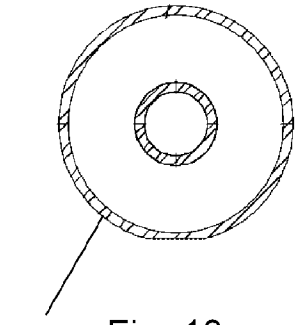
Figure 10D:
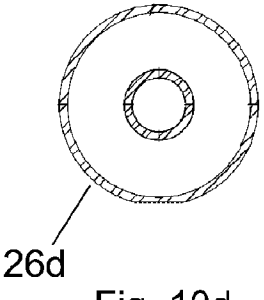

According to first variant of the first embodiment shown in FIG. 2, a thermal fuse 29 incorporated in the first closing element 5' is provided. The first closing element 5' is provided with a housing 27, or cavity, in which the thermal fuse 29 is provided. In this case, the pin 11' is divided into two parts 33, 34, of which an inner part 34 extends inside the tubular casing 2. The thermal fuse 29 is arranged in contact between the parts 33, 34. The part 34 inside the tubular casing 2 of the pin 11' is connected to a rheophore 31, which, in turn, is electrically connected to an end 13 of the resistance wire 3. FIG. 9 shows two details of an example of how the part 34 may be connected to the rheophore 31, and how the latter may be connected to the resistance wire 3. Such a connection may be used whenever a rheophore is provided.

The inner part 34 has a tapered portion 37 and the through hole of the closing element 5' has a similar geometric part, so that the inner part 34 abuts on the latter and thus on the first closing element 5'.

Figure 3:
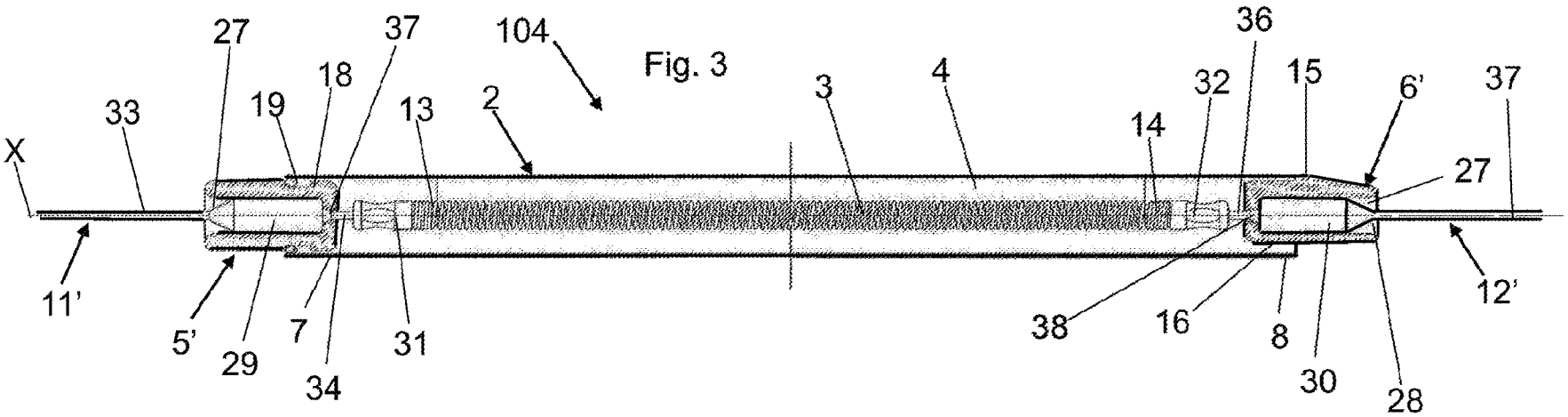
FIG. 3 shows a section view of another variant of the first embodiment of the invention.
Figure 3A:
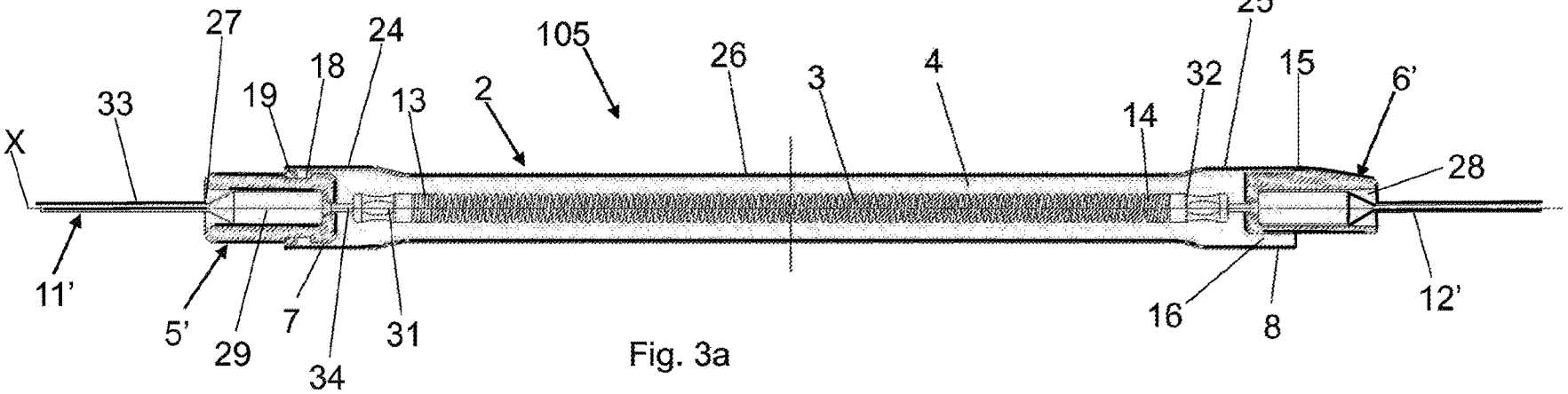

According to a second variant of the first embodiment, shown in FIG. 3, in addition to the first closing element 5', the second closing element 6' also has a thermal fuse 30 incorporated therein, in particular accommodated in the housing 28. The thermal fuse 30 is electrically connected to the end 14 of the resistance wire 3 by means of a rheophore 32. In this case, the pin 12' is divided into two parts 35, 36, of which an inner part 36 extends inside the tubular casing 2. The thermal fuse 30 is arranged in contact between the parts 35, 36. The part 36 inside the tubular casing 2 of the pin 11' is connected to the rheophore 32, which, in turn, is electrically connected to an end 14 of the resistance wire 3. The inner part 36 has a tapered portion 38 and the through hole of the closing element 6' has a similar geometry, so that the inner part 36 abuts on the latter and thus on the second closing element 6.

According to a third variant, not shown, only the second closing element has a thermal fuse incorporated inside.

According to further variants, with reference to FIGS. 1*a*, 1*b*, 1*c*, preferably but not exclusively, in the first embodiment, including the variants described above, the tubular casing 2 has two end portions 24, 25 comprising the two ends 7, 8, respectively, and a central portion 26, comprised between two end portions 24, 25, in which the area, according to a section taken along a plane orthogonal to the longitudinal axis X, of the central portion 26 is smaller than the area of the first end portion 24 and second end portion 25. For example, the section of the central portion 26 may be circular with extension area preferably but not exclusively comprised between 0.50 and 0.70 $cm^2$. Alternatively, the central portion section 26 may be shaped as a regular polygon, e.g. an hexagon. Examples of central portion are shown in FIGS. 10*a*-10*d*.

Figure 4:
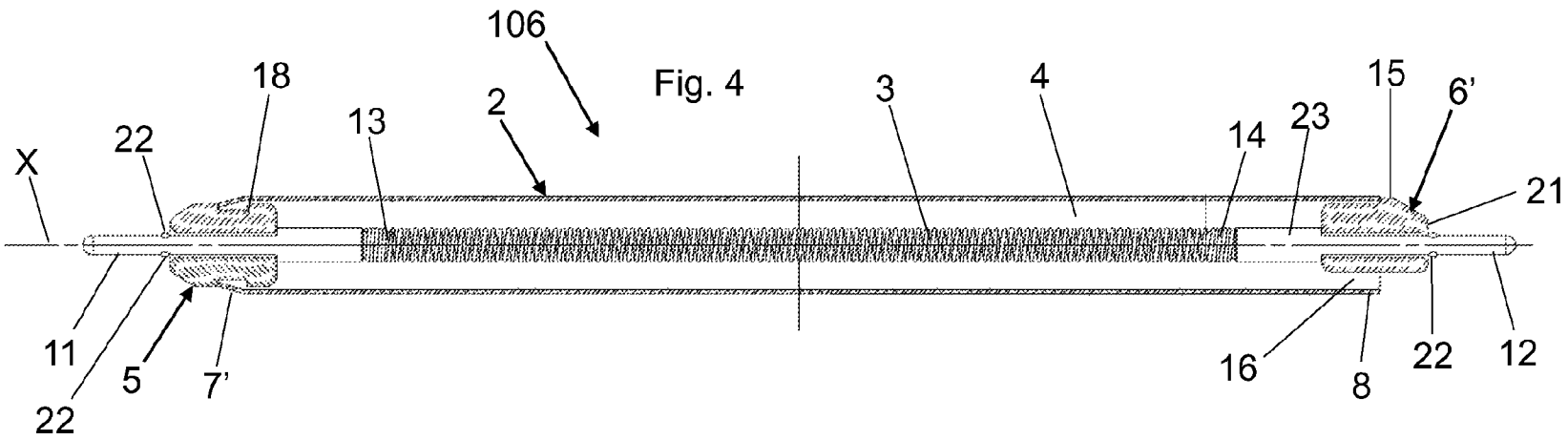
FIG. 4 shows a section view of a second embodiment of the invention.

With particular reference to FIG. 4, there is no O-ring in a second embodiment. The fluid-tight closing between the first closing element 5 and the tubular casing 2 is guaranteed because the end 7' of the tubular casing 2 is in close contact with or secured against the groove 18. The tightening of the end 7' with the groove 18 is obtained preferably by means of localized pressing obtained from the outside. Besides this difference of construction, the second embodiment is entirely identical to the first embodiment, and thus the second embodiment will not be described further.

Figure 5:
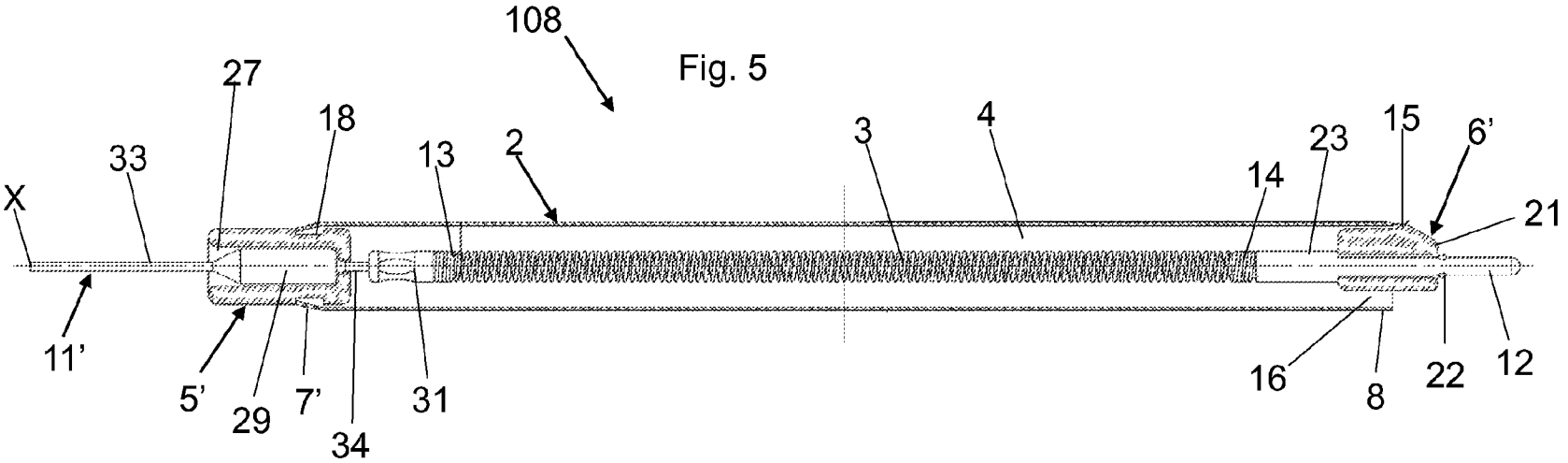
FIG. 5 shows a section view of a variant of the second embodiment of the invention.

In particular, the second embodiment comprises the previously described variants. Of the three variants of this embodiment, corresponding to the variants of the previous embodiments, two are shown in FIGS. 5 and 6, respectively.

Figure 4A:
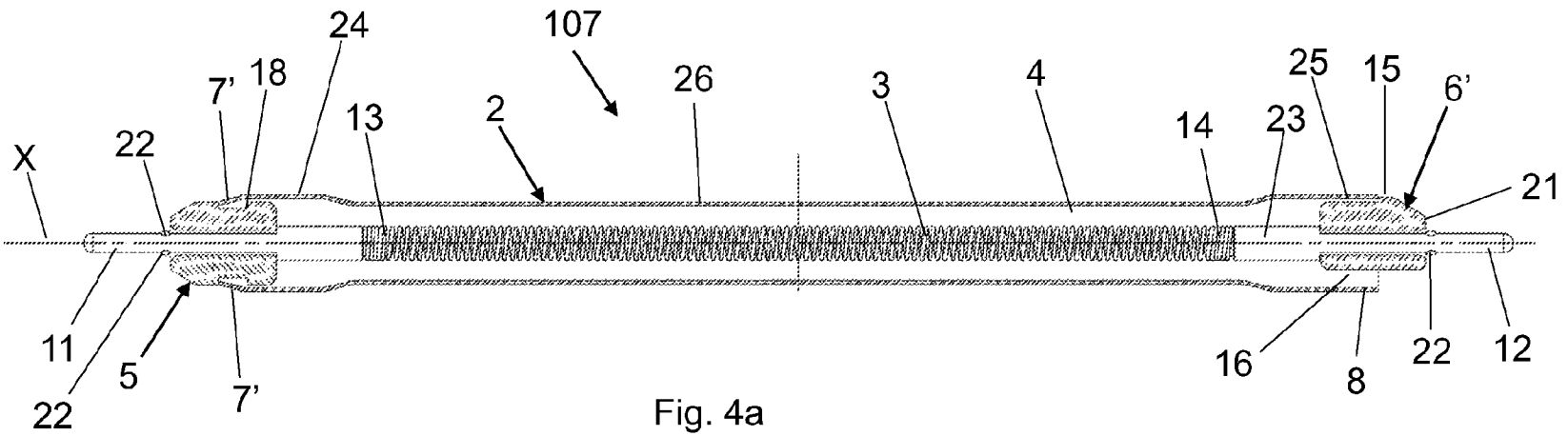
Figure 5A:
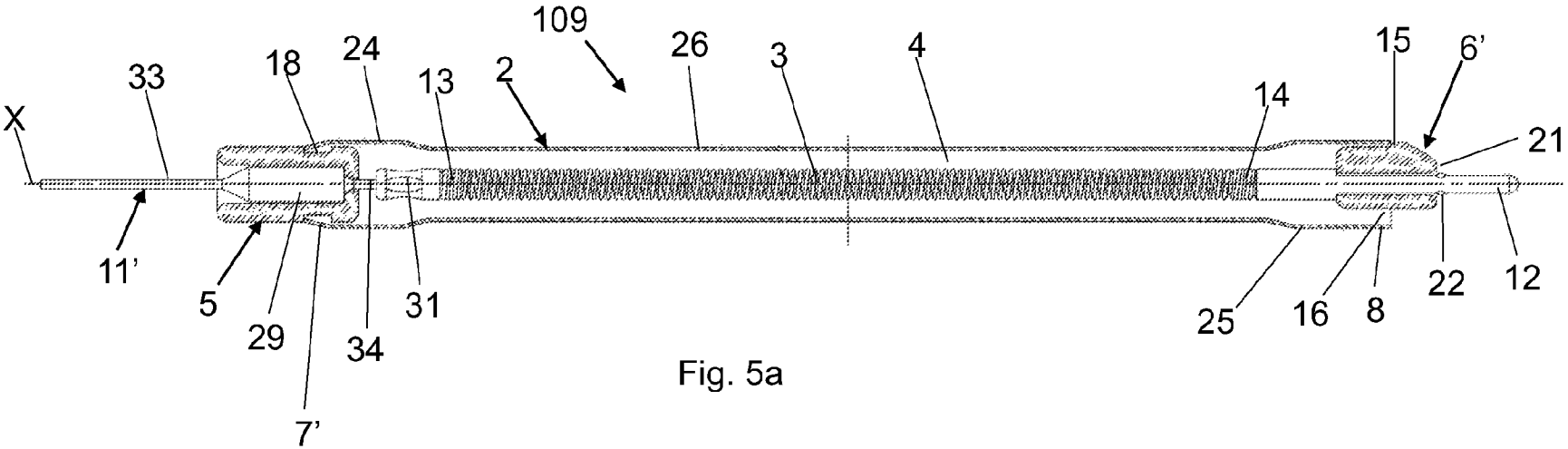
Figure 6A:
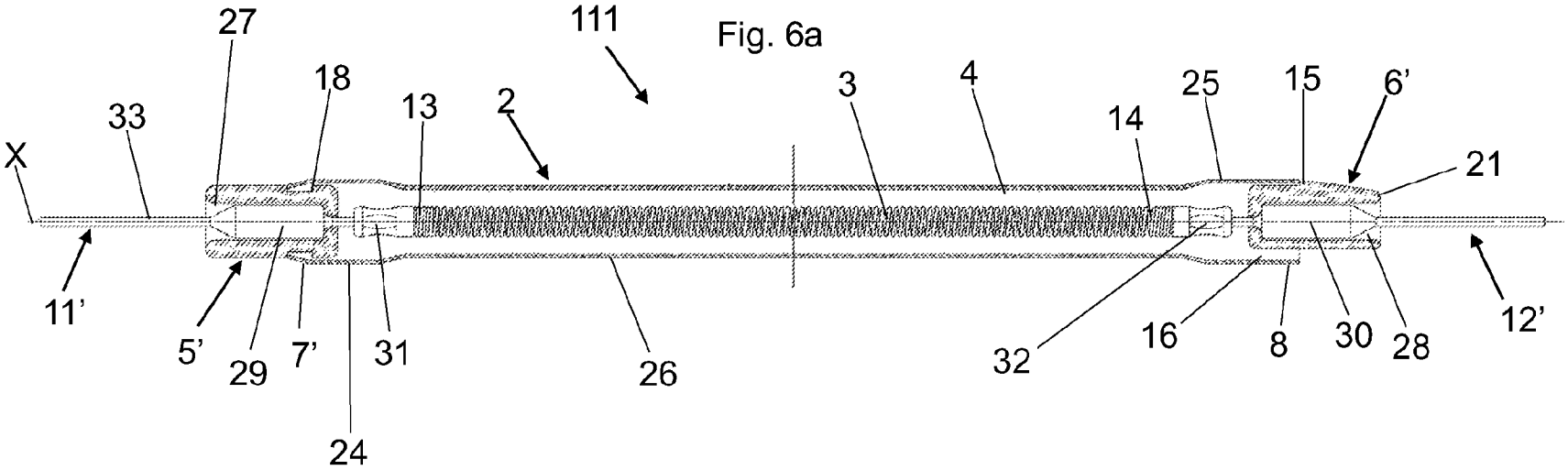

As described for the previous embodiment, the possibility of having the central portion with the section area smaller than the two end portions is also provided. Such a feature is shown in FIGS. 4*a*, 5*a* and 6*a*.

According to an aspect, the invention also provides a process for manufacturing an armored resistor.

The process includes the following steps.

Step A: inserting each pin 11, 12 into a respective hole of the first closing element 5 and second closing element 6.

Step B: fixing each pin 11, 12, preferably by welding or brazing, to a respective end 13, 14 of the heating element 3, thus producing an intermediate assembly; the intermediate assembly comprises two closing elements 5, 6, the two pins 11, 12, and the resistance wire 3. When one or more thermal fuses are provided, the intermediate assembly also comprises the thermal fuse or thermal fuses and the respective rheophore or rheophores.

Step C: inserting the first assembly into the tubular casing 2, so that the first closing element 5 and the respective pin 11 enter first, and make the first closing element 5 abut on the end 8. For example, the first closing element 5 may be inserted from the end 8 of the tubular casing 2, and may be made to slide in the tubular casing 2 until the protrusions 15 of the second closing element 6 abut on the end 7;

Step D: fixing the first closing element with the end 8 of the casing in fluid-tight or sealed manner; preferably, fixing is performed by inserting the O-ring or by pressing the end 7' from the outside; once the first closing element 5, is fixed the second closing element 6 is maintained in position also by virtue of the resistance wire 3; indeed, as previously described, the latter is wound as a helix and is dimensioned so as to be able to exert an elastic return on the second closing element 6;

Step E: filling the tubular casing 2 with electrically insulating material in the form of powder by means of the at least one passage 16.

Step F: consolidating the electrically insulating material so as to make it a compact mass; preferably, the electrically insulating material is magnesium oxide, of the type which also comprises a monomer, e.g. siliconic, so that the consolidation of the magnesium oxide may occur by means of heat. The consolidation of the magnesium oxide contributes to holding the assembly described above in position with the tubular casing 2.

The process is particularly advantageous because the filling operation occurs by means of the at least one passage of the second closing element; the fluid-tight closing of the first closing element with the tubular casing, by means of the O-ring and the pressing, prevents the release of the electrically insulating material in powder form during filling.

After step (f) a step (g) may be envisaged in which the central portion of the casing is pressed from the outside. Advantageously, by pressing the portion only, the possible thermal fuses are not damaged.

Furthermore, a step of plugging of the holes by means of filling material may be envisaged.

The invention claimed is:

1. An armored resistor comprising:

a tubular casing defining a longitudinal axis X and having a first end and a second end;

a metal, spiral-coiled heating element, arranged inside the tubular casing, immersed in an electrically insulating material, and having two ends;

a first closing element and a second closing element fixed to the first end and second end, respectively, and each provided with a respective through hole;

two pins adapted to be connected to a source of electricity, wherein each pin is in electrical contact with one of said two respective ends of the heating element and wherein each pin passes through a respective closing element; wherein the first closing element is fluid-tightly fixed to the respective first end of the tubular casing, and has a peripheral groove in which an O-ring is arranged between a wall of the peripheral groove and the first end of the tubular casing, and the second closing element is provided with at least one passage communicating with the inside of the tubular casing, adapted to allow the electrically insulating material in the form of powder to pass when manufacturing the armored resistor, and wherein the tubular casing has a first end portion and a second end portion comprising the first end and the second end of the tubular casing, respectively, and a central portion, between the first end portion and the second end portion wherein the area, according to a section on a plane orthogonal to the longitudinal axis X, of the central portion is smaller than the area of the first end portion and second end portion.

2. The armored resistor according to claim 1, wherein there are provided at least three passages.

3. The armored resistor according to claim 1, wherein at least one thermal fuse is provided electrically connected to one of the two ends of the heating element by means of a rheophore, and wherein the at least one thermal fuse is incorporated in at least either the first closing element or the second closing element.

4. The armored resistor according to claim 1, wherein two thermal fuses are provided being electrically connected by means of a respective rheophore to a respective end of the heating element, and wherein the two thermal fuses are incorporated in the first closing element and in the second closing element, respectively.

5. The armored resistor according to claim 1, wherein said through holes of the first closing element and of the second closing element are shut.

6. The armored resistor according to claim 1, wherein the tubular casing is made of metal material, preferably steel or aluminum, and the electrically insulating material consists of at least magnesium oxide.

7. A process for manufacturing an armored resistor having the features of claim 1, wherein there are provided the steps of:

a) inserting each pin into a respective hole of the first closing element and second closing element;

b) fixing each pin to a respective third end and fourth end of the heating element, thus producing an intermediate assembly;

c) inserting the intermediate assembly into the tubular casing, so that the first closing element and the respective pin enter first, and make the second closing element abut on the second end the tubular casing;

d) fixing the first closing element with the first end of the tubular casing;

e) filling the tubular casing with electrically insulating material in the form of powder by means of the at least one passage;

f) consolidating the electrically insulating material so as to make it a compact mass;

g) reducing the area of the third central portion of the tubular casing by a pressure exerted from the outside; and h) plugging said holes by means of filling material.

* * * * *